US005584756A

United States Patent [19]

Grapengiser et al.

[11] Patent Number: 5,584,756

[45] Date of Patent: Dec. 17, 1996

[54] LEG STRETCHING APPARATUS

[76] Inventors: Steven C. Grapengiser, 1410 E. Bell Ave., Anaheim, Calif. 92805; Craig C. Mills, 7924 Stapleton, Plano, Tex. 75025

[21] Appl. No.: 426,983

[22] Filed: Apr. 21, 1995

[51] Int. Cl.[6] ..... A63B 23/00

[52] U.S. Cl. ..... 482/92; 482/907

[58] Field of Search ..... 482/907, 97, 142, 482/92

[56] References Cited

U.S. PATENT DOCUMENTS

| | | | |
|---|---|---|---|
| 4,781,373 | 11/1988 | Irwin | 482/907 |
| 4,877,239 | 10/1989 | Del Rosa | 482/907 |
| 4,936,572 | 6/1990 | Desiderio | 482/142 |
| 5,108,090 | 4/1992 | Reed | 482/907 |
| 5,184,991 | 2/1993 | Brangi | 482/97 |

*Primary Examiner*—Stephen R. Crow
*Attorney, Agent, or Firm*—Lisa L. B. Yociss

[57] ABSTRACT

A leg stretching apparatus is disclosed. The leg stretching apparatus includes a pair of leg assemblies, a handle assembly, and attachment means for securing each leg assembly to the handle assembly. Each leg assembly includes a first leg including a pivot end and an opposite end, and a second leg including a first end slidingly received within the opposite end of the first leg and an opposite end for engaging a user's legs. First means for securing the second leg within the first leg are included so that movement of the second leg is prohibited. The handle assembly includes a first handle having a first and second side and a first and second end, and a second handle having a first and second end. The first end of the second handle is slidingly received within the second end of the first handle. The second end of the second handle may be grasped by a user when the leg stretching apparatus is in use. Second means for securing the second handle within the first handle are included so that movement of the second handle is prohibited. A pair of attachment means are utilized to secure the first leg of one leg assembly to the first side of the first handle, and to secure the first leg of the other leg assemble to the second side of the first handle. The attachment means are adapted for moving the opposite ends of each first leg generally away from the other in a general arc about the pivot ends of each first leg to an open position.

14 Claims, 2 Drawing Sheets

LEG STRETCHING APPARATUS

BACKGROUND OF THE INVENTION

1. Technical Field

The present invention relates to a leg stretching apparatus, and in particular to a leg stretching apparatus including a pair of leg stretching assemblies, a handle assembly, and a pair of hinges for securing each leg assembly to the handle assembly.

2. Description of the Related Art

Devices used for leg stretching are generally known in the art. For example, U.S. Pat. No. 5,328,426 issued to Vendette describes a wall mounted exercise device. A telescopic section is included within a rectangular tube. Once the desired length for the rectangular tube and telescopic section is obtained, the telescopic section is secured to the rectangular tube. A user stands and may stretch only one leg at a time utilizing the tube and telescopic section.

U.S. Pat. No. 4,877,239 issued to Dela Rosa describes a generally V-shaped stretching device whereby a user sits on a seat at the opening of the V, forming a diamond with the V. The device includes a rotatable handle and worm gear utilized by the user to increase or decrease the width of the V, and thus increasing the amount the user is stretching.

U.S. Pat. No. 4,781,373 issued to Irwin describes a V-shaped stretching machine including two main legs, a handle, and two telescopic legs. The telescopic legs are not secured to the main legs when the machine is in use. The main legs and handle are secured together utilizing a first base secured to the top and a second base secured to the bottom of the main legs and handle. The handle is secured to each base utilizing two bolts, while each main leg is secured utilizing only one bolt. Means are provided which prohibit each telescopic leg from moving further into the main leg. The telescopic leg may rotate 360 degrees when in use. The user sits at the opening of the V and places ankles in U-shaped stirrups located on one end of each telescopic leg and grasps the handle. When the user moves the handle, the main legs move in the same plane as the handle, while the telescopic legs rotate. This causes the U-shaped stirrups to rotate.

SUMMARY OF THE INVENTION

A leg stretching apparatus is disclosed. The leg stretching apparatus includes a pair of leg assemblies, a handle assembly, and hinges for securing each leg assembly to the handle assembly. Each leg assembly includes a first leg including a pivot end and an opposite end, and a second leg including a first end slidingly received within the opposite end of the first leg and an opposite end for engaging a user's legs. A first pin for securing the second leg within the first leg is included so that movement of the second leg is prohibited. The handle assembly includes a first handle having a first and second side and a first and second end, and a second handle having a first and second end. The first end of the second handle is slidingly received within the second end of the first handle. A second pin for securing the second handle within the first handle is included so that movement of the second handle is prohibited. Hinges are utilized to secure the first leg of one leg assembly to the first side of the first handle, and to secure the first leg of the other leg assembly to the second side of the first handle. The hinges are adapted for moving the opposite end of one first leg generally away from the opposite end of the other first leg in a general arc about the pivot ends of each first leg so that the leg stretching apparatus is in an open position.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
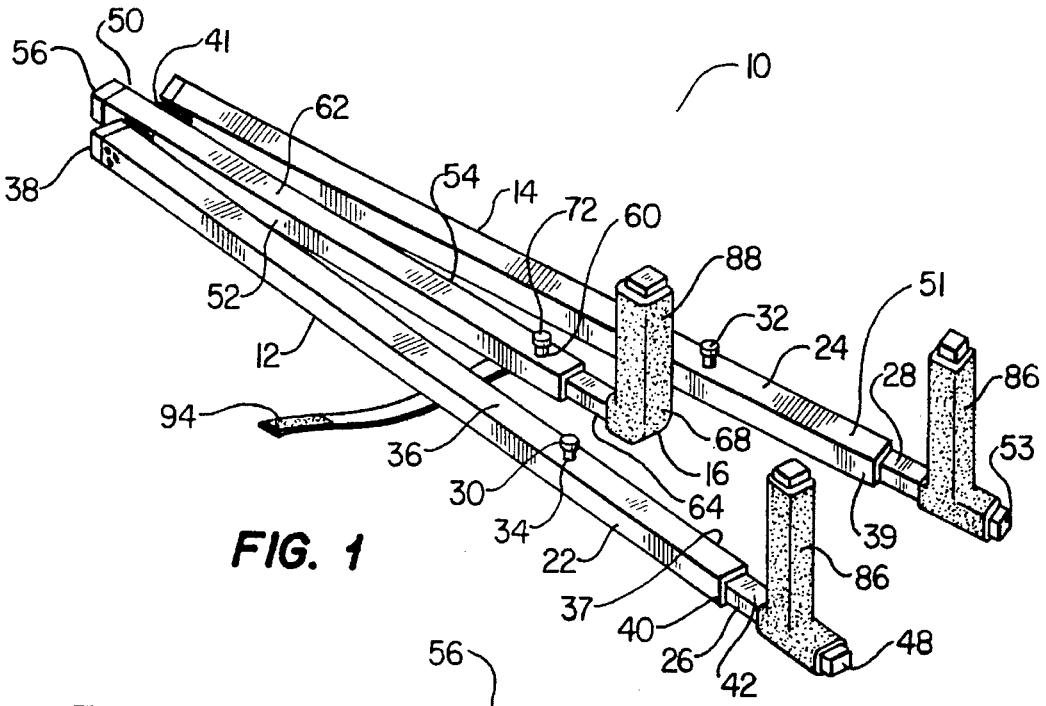
FIG. 1 is a perspective view of a leg stretching apparatus in accordance with the present invention.
Figure 2:
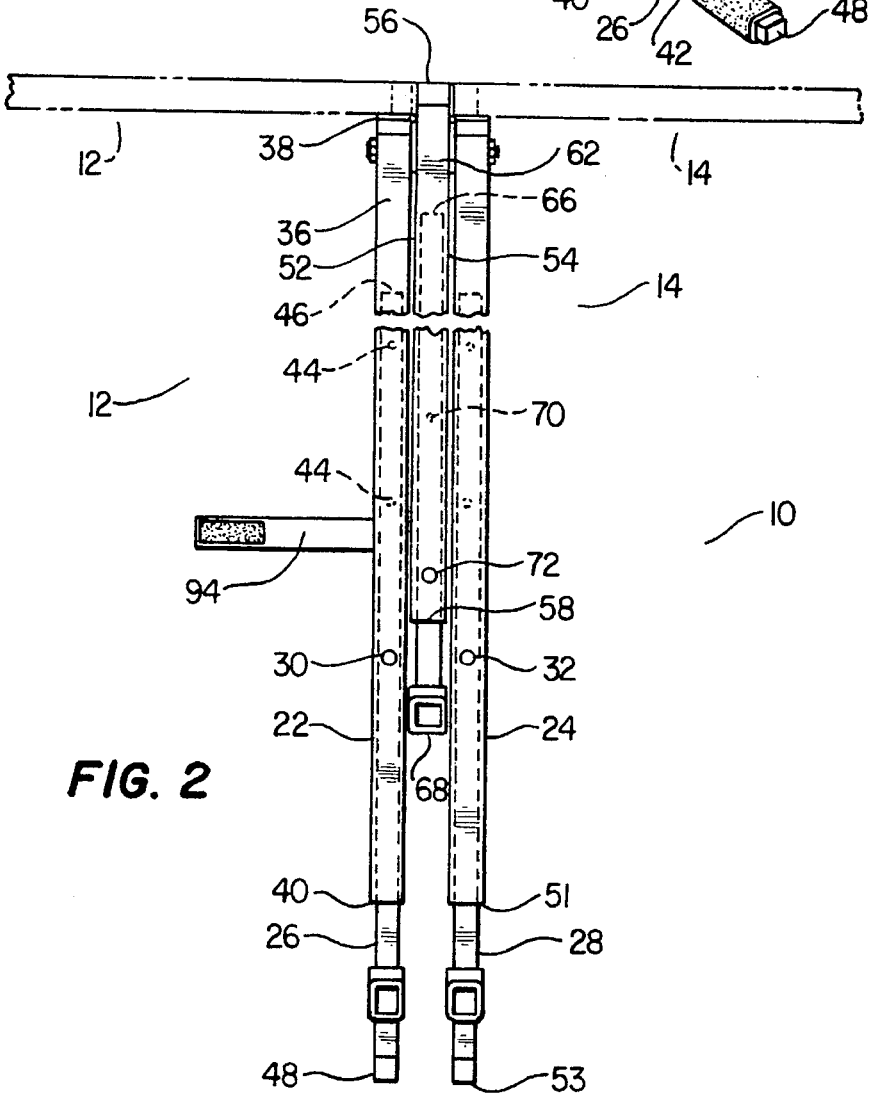
FIG. 2 is a top view of a leg stretching apparatus in the fully closed position with the fully open position of the leg stretching apparatus shown in phantom in accordance with the present invention.
Figures 3, 4, 5:
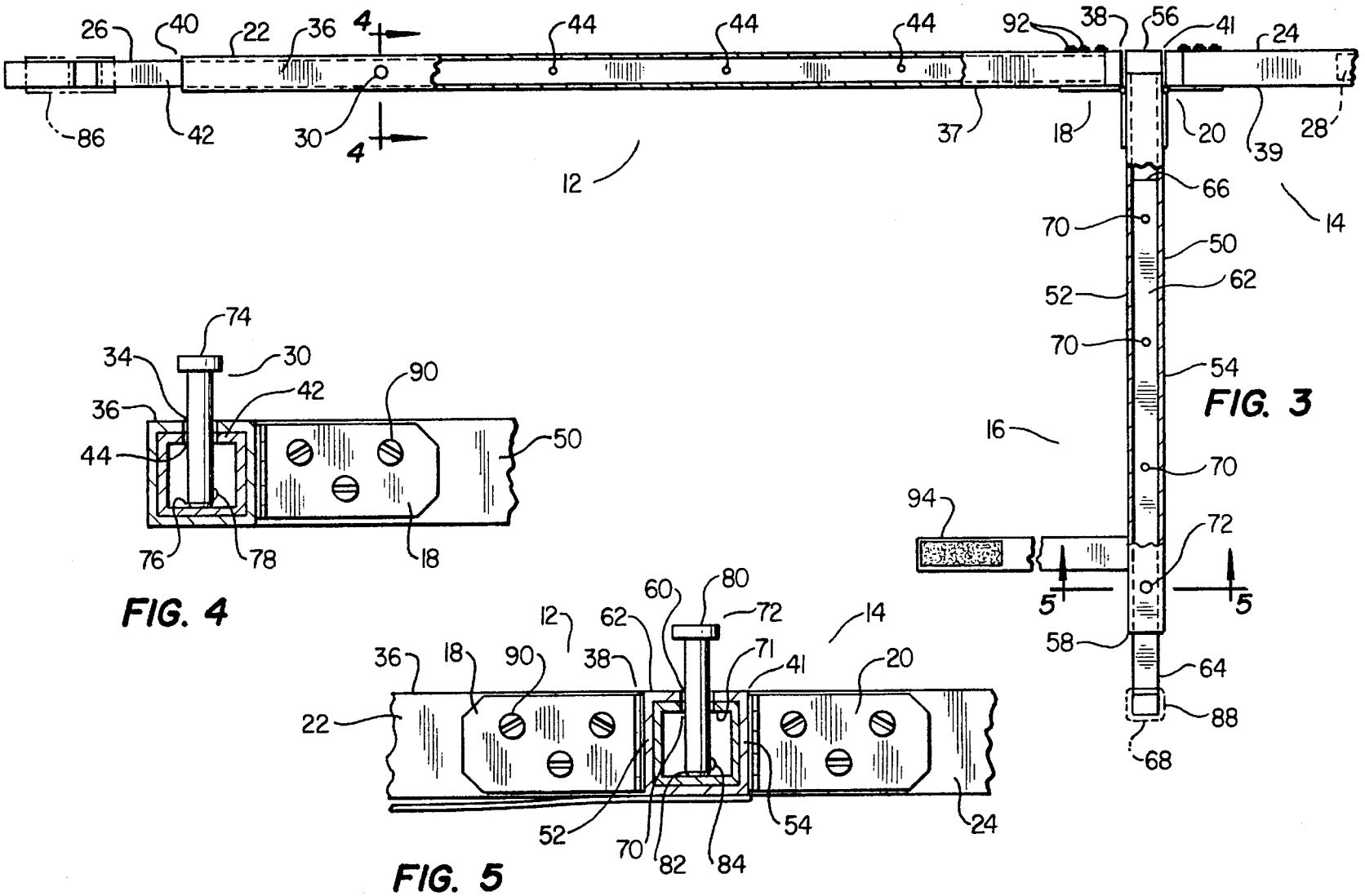
FIG. 3 is a top partial view of a leg stretching apparatus in the fully open position in accordance with the present invention.
FIG. 4 is a side view of a pin, a hinge, and a first handle included within a leg stretching apparatus in accordance with the present invention taken along line 4—4 shown in FIG. 3.
FIG. 5 is a side view of a pin, a pair of hinges, and a first leg of each of a pair of leg assemblies in accordance with the present invention taken along line 5—5 shown in FIG. 3.

With reference now to the figures, FIG. 1 depicts a perspective view of a leg stretching apparatus 10 in accordance with the present invention. FIG. 2 is a top view of a leg stretching apparatus in the fully closed position with the fully open position of the leg stretching apparatus shown in phantom in accordance with the present invention. FIG. 3 is a top partial view of a leg stretching apparatus in the fully open position in accordance with the present invention. FIG. 4 is a side view of a pin, a hinge, and a first handle included within a leg stretching apparatus in accordance with the present invention taken along line 4—4 shown in FIG. 3. FIG. 5 is a side view of a pin, a pair of hinges, and a first leg of each of a pair of leg assemblies in accordance with the present invention taken along line 5—5 shown in FIG. 3.

Leg stretching apparatus 10 includes leg assemblies 12 and 14, handle assembly 16, and attachment means 18 and 20. Leg assembly 12 includes a first elongate leg 22, a second elongate leg 26, and a first means 30 for securing first leg 22 to second leg 26. First leg 22 is preferably formed from square steel tubing having a 0.75 inch width. Second leg 28 is preferably formed from square steel tubing having a 0.625 inch width. Leg assembly 14 is identical to leg assembly 12 and includes a first leg 24, a second leg 28, and a first means 32 for securing first leg 24 to second leg 28. Leg assembly 12 will be described in detail. However, one of ordinary skill in the art will recognize that the description of leg assembly 12 applies equally to the similar elements of leg assembly 14.

First leg 22 includes a hole 34 through a top 36 of first leg 22, a pivot end 38, and an opposite end 40. Second leg 26 includes a top 42, a plurality of holes 44 through top 42, a first end 46, and an opposite end 48. First means 32 for securing are utilized to secure first leg 22 to second leg 26. One of the plurality of holes 44 must first be aligned with hole 34. First means 32 are then inserted into the aligned holes 44 and 34 in order to secure first leg 22 to second leg 26. A user may adjust the portion of second leg 26 which protrudes from first leg 22 in order to customize leg stretching apparatus 10 to the particular user's physical size by selecting a different hole 44. In this manner, leg stretching apparatus 10 may be utilized by users having a wide range of heights. Those skilled in the art will recognize that second leg 28 may be adjusted within first leg 24 included within leg assembly 14 in the same manner as leg assembly 12. Opposite ends 48 and 53, respectively, of second legs 26 and 28 are generally an inverted T-shape and engage a user's ankles or knees when leg stretching apparatus 10 is in use. A pair of first cushions 86 are provided around opposite ends 48 and 53 to provide comfort to a user. When in use, a user places his ankles or knees against cushions 86.

Handle assembly 16 includes a first handle 50 and a second handle 64. First handle 50 is preferably formed from square steel tubing having a 0.75 inch width. Second handle 64 is preferably formed from square steel tubing having a 0.625 inch width. First handle 50 includes a first side 52, a second side 54, a first end 56, a second end 58, and a hole 60 through a top 62 of first handle 50. Second handle 64 includes a first end 66, second end 68, and a plurality of holes 70 through a top 71 of second handle 64. A second means 72 is utilized for securing first handle 50 to second handle 64. One of the plurality of holes 70 must first be aligned with hole 60. Second means 72 are then inserted into the aligned holes 60 and 70 in order to secure first handle 50 to second handle 64. A user may adjust the portion of second handle 64 which protrudes from first handle 50 in order to customize handle assembly 16 to the particular user's physical size by selecting a different hole 70. Second end 68 of second handle 64 is generally L-shaped for providing an area for a user to grasp. A second cushion 88 is provided around second end 68 to provide comfort to a user.

Attachment means 18 and 20 are utilized to secure leg assembly 12 and leg assembly 14 to handle assembly 16, respectively. Attachment means 18 and 20 are preferably hinges. Side 37 of first leg 22 is secured to first side 52 of first handle 50 utilizing hinge 18. Hinge 18 is secured to both first leg 22 and first handle 50 utilizing screws 90 and nuts 92. Side 39 of first leg 24 is secured to second side 54 of first handle 50 utilizing hinge 20. In this manner leg assembly 12 and leg assembly 14 may move, with opposite end 40 of first leg 22 moving away from opposite end 51 of first leg 24, generally in an arc about pivot ends 38 and 41.

In this manner, leg stretching apparatus 10 may extend from a fully closed position as shown in FIG. 2 to a fully open position shown in phantom also in FIG. 2. When in the fully open position, leg assembly 12 is positioned in a horizontal plane 180 degrees from leg assembly 14, so that leg assemblies 12 and 14 are each perpendicular to handle assembly 16. First leg 22 is secured to first side 52 of first handle 50 near first end 56 of first handle 50 utilizing hinge 18. First leg 24 is secured to second side 54 of first handle 50 near first end 56 of first handle 50 utilizing hinge 20. In this manner, when leg stretching apparatus 10 is in use and is in the fully open position, first leg 22 and 24 are fully engaged with first handle 50 so that first handle 50 provides a structural support for a portion of the amount of force being applied to first leg 22 and 24 by a user.

First means 30 and 32 and second means 72 are preferably implemented utilizing a pin. Pins 30 and 32 include an exposed end 74, a distal end 76, and a small protrusion 78 located near distal end 76. Pin 72 is identical to pins 30 and 32 and includes an exposed end 80, a distal end 82, and a small protrusion 84 located near distal end 82.

Pins 30, 32, and 72 are sized slightly smaller than holes 34, 44, 60, and 70. In this manner pins 30, 32, and 72 fit snugly into the respective holes and remain in place while leg stretching apparatus 10 is utilized. Protrusions 78 and 84 are pushed inward slightly during insertion into the holes. Once inserted into the holes, protrusions 78 and 84 regain their original shape and are provided to prohibit pins 30 and 32, and 72 from unintentionally slipping from their respective holes.

A strap 94 is provided to wrap around leg assemblies 12 and 14, and handle assembly 16 when leg stretching apparatus 10 is not in use. In this manner, leg stretching apparatus 10 may be conveniently stored or transported. Strap 94 is preferably formed from a hook and loop material.

In operation, leg stretching apparatus 10 is utilized in a generally horizontal plane. A user sits near opposite ends 48 and 53, and second end 68. A user first typically adjusts the portion of second legs 26 and 28 which protrude from first legs 22 and 24, and the portion of second handle 64 which protrudes from first handle 50. A user makes these adjustments by sliding second leg 26 into or out of first leg 22 to align hole 34 with one of holes 44 to obtain the desired total length for leg assembly 12. This same method is utilized to achieve the desired total length for leg assembly 14. Once the desired total lengths are achieved, distal end 76 of pin 30 is inserted into both hole 34 and the selected hole 44. While pin 30 is being inserted, small protrusion 78 is temporarily pushed inward. When pin 30 is in place, small protrusion 78 regains its original shape. A user then slides second handle 64 into or out of first handle 50 to align hole 60 with one of holes 70 to obtain the desired total length for handle assembly 16. Once the desired length is achieved, distal end 82 of pin 72 is inserted into both hole 60 and selected hole 70. While pin 72 is being inserted into the holes, small protrusion 84 is temporarily pushed inward. When pin 72 is in place, small protrusion 84 regains its original shape. A user may start a stretching exercise with leg stretching apparatus 10 in a partially open position as shown in FIG. 1. As a user performs a greater stretch, opposite end 40 moves further from opposite end 51 until a fully open position of leg stretching apparatus 10 is achieved, such that leg assembly 12 is 180 degrees from leg assembly 14.

The invention has significant advantages. The leg stretching apparatus may be customized to a particular user's size by adjusting each second leg and the second handle. The pins provide a means for securing each second leg and second handle to the first legs and the first handle so that the leg stretching apparatus is stable while in use. In addition, the hinges are utilized and positioned so as to enable each first leg to fully engage the first handle when the leg stretching apparatus is in the fully open position. In this manner, first handle provides some support to each of the first legs.

The opposite ends of each of the second legs are adapted to receive either a user's ankles or knees to prevent knee strain or injury. The user can customize the leg stretching apparatus to his or her particular size and stretching needs by adjusting the second legs and the second handle and prevent unnecessary stress and strain on the user's lower back. The second legs and second handle are adapted to so as to permit stretching of the leg muscles including the calf muscles and the groin region. Cushions are provided around the second legs and the second handle to provide comfort to a user and to permit the use of the leg stretching apparatus on any surface without scratching the surface.

The leg stretching apparatus is formed from steel to be durable and strong enough to permit maximum intensity stretching. The hinges and the placement of the hinges permit maximum stretching while prohibiting a stretch greater than 180 degrees, thus possibly preventing some injuries.

While the invention has been particularly shown and described with reference to a preferred embodiment, it will be understood by those skilled in the art that various changes in form and detail may be made therein without departing from the spirit and scope of the invention.

What is claimed is:

1. A leg stretching apparatus comprising:

a pair of leg assemblies, each of said pair of leg assemblies including a first leg and a second leg, said first leg having a pivot end and an opposite end, said second leg having a first end slidingly received within said opposite end of said first leg, and said second leg having an opposite end adapted to engage a user's legs;

a first means for removably securing said second leg within said first leg so that movement within said first leg of said second leg is prohibited during use of said leg stretching apparatus, wherein said second leg is temporarily secured within said first leg and may be easily removed when said first means for securing are not utilized;

a handle assembly including a first handle having a first side and a second side and having a first end and a second end, and a second handle having a first end and a second end, said first end of said second handle slidingly received within said second end of said first handle;

a second means for removably securing said second handle to said first handle so that movement within said first handle of said second handle is prohibited during use of said leg stretching apparatus, wherein said second handle is temporarily secured within said first handle and may be easily removed when said second means for securing are not utilized;

a pair of attachment means for securing each of said pair of leg assemblies to said handle assembly, wherein for one of said pair of leg assemblies said first leg is secured to said first side of said first handle and for the other of said pair of leg assemblies said first leg is secured to said second side of said first handle, said pair of attachment means being adapted for moving said opposite end of said first leg of said one of said pair of leg assemblies generally away from said opposite end of said first leg of said other of said pair of leg assemblies generally in an arc about said pivot end of said first leg of said one and said other of said pair of leg assemblies to an open position.

2. The leg stretching apparatus according to claim 1, further comprising a hole through a top of said first leg and a plurality of holes through a top of said second leg, one of said plurality of holes through said second leg being aligned with said hole in said first leg, wherein said first means for securing comprises a first pin received in said hole in said first leg and said one of said plurality of holes in said second leg; and a hole through a top of said first handle and a plurality of holes through a top of said second handle, wherein said second means for securing comprises a second pin received in said hole in said first handle and said one of said holes in said second handle.

3. The leg stretching apparatus according to claim 2 further comprising said first pin including an exposed end and a distal end, said distal end received within said second leg and having a small protrusion located near said distal end for preventing said first pin from easily sliding out of said hole in said first leg and said hole in said second leg, said exposed end being larger than either said hole in said first leg or said one of said plurality of holes in said second leg; and said second pin including an exposed end and a distal end, said distal end received within said second handle and having a small protrusion located near said distal end for preventing said second pin from easily sliding out of said hole in said first handle and said one of said plurality of holes in said second handle, said exposed end being larger than either said hole in said first handle or said one of said plurality of holes in said second handle.

4. The leg stretching apparatus according to claim 1 further comprising a cushion secured to said opposite end of said second leg and a cushion secured to said second end of said second handle.

5. The leg stretching apparatus according to claim 1 wherein said pivot end of said first leg is fully engaged with said first handle when each of said pair of leg assemblies is in a fully open position wherein each of said pair of leg assemblies is perpendicular to said handle assembly.

6. The leg stretching apparatus according to claim 1 wherein said opposite end of said second leg is generally an inverted T-shape, and said second end of said second handle is generally L-shaped.

7. The leg stretching apparatus according to claim 1 wherein said first leg, said second leg, said first handle, and said second handle have a generally square cross section.

8. A leg stretching apparatus comprising:

a pair of leg assemblies, each of said pair of leg assemblies including a first elongate leg and a second elongate leg, said first leg having a generally square cross section, a pivot end, and an opposite end, said second leg having a generally square cross section, a first end slidingly received within said opposite end of said first leg, and said second leg having an opposite generally inverted T-shaped end adapted to engage a user's legs;

a first means for removably securing said second leg within said first leg so that movement within said first leg of said second leg is prohibited during use of said leg stretching apparatus, wherein said second leg is temporarily secured within said first leg and may be easily removed when said first means for securing are not utilized;

a handle assembly including a first elongate handle having a generally square cross section, a first side, a second side, and having a first end and a generally L-shaped second end, and a second elongate handle having a generally square cross section, a first end, and a second end, said first end of said second handle slidingly received within said second end of said first handle, wherein a user may grasp said L-shaped second end of said second handle;

a second means for removably securing said second handle to said first handle so that movement within said first handle of said second handle is prohibited during use of said leg stretching apparatus, wherein said second handle is temporarily secured within said first handle and may be easily removed when said second means for securing are not utilized;

a pair of attachment means for securing each of said pair of leg assemblies to said handle assembly, wherein for one of said pair of leg assemblies said first leg is secured to said first side of said first handle near said first end of said first handle, and for the other of said pair of leg assemblies said first leg is secured to said second side of said first handle near said first end of said first handle, said pair of attachment means being adapted for moving said opposite end of said first leg of said one of said pair of leg assemblies generally away from each other generally in an arc about said pivot end of said first leg of the said other of said pair of leg assemblies; and said pivot end of said first leg being fully engaged with said first handle when each of said pair of leg assemblies is in a fully open position wherein each of said pair of leg assemblies is perpendicular to said handle assembly.

9. The leg stretching apparatus according to claim 8 further comprising a cushion secured to said opposite end of said second leg and a cushion secured to said second end of said second handle.

10. The leg stretching apparatus according to claim 8, further comprising a hole through a top of said first leg and a plurality of holes through a top of said second leg, one of said plurality of holes through said second leg being aligned with said hole in said first leg, wherein said first means for securing comprises a first pin received in said hole in said first leg and said one of said plurality of holes in said second leg; and a hole through a top of said first handle and a plurality of holes through a top of said second handle, wherein said second means for securing comprises a second pin received in said hole in said first handle and said one of said plurality of holes in said second handle.

11. The leg stretching apparatus according to claim 10 further comprising said first pin including an exposed end and a distal end, said distal end received within said second leg and having a small protrusion located near said distal end for preventing said first pin from easily sliding out of said hole in said first leg and said one of said plurality of holes in said second leg, said exposed end being larger than either said hole in said first leg or said one of said plurality of holes in said second leg; and said second pin including an exposed end and a distal end, said distal end received within said second handle and having a small protrusion located near said distal end for preventing said second pin from easily sliding out of said hole in said first handle and said one of said plurality of holes in said second handle, said exposed end being larger than either said hole in said first handle or said one of said plurality of hole in said second handle.

12. A leg stretching apparatus comprising:

a pair of leg assemblies, each of said pair of leg assemblies including a first elongate leg and a second elongate leg, said first leg having a hole through a top of said first leg and having a generally square cross section, a pivot end, and an opposite end, said second pair of legs having a top, a plurality of holes through said top of said second leg, and having a generally square cross section, a first end slidingly received within said opposite end of said first leg so that one of said plurality of holes in said second leg is aligned with said hole in said first leg, and said second leg having an opposite, generally inverted T-shaped end adapted to engage a user's legs;

a first pin removably received in said hole in said first leg and said one of said plurality of holes in said second leg for securing said second leg within said first leg so that movement within said first leg of said second leg is prohibited during use of said leg stretching apparatus, wherein said second leg is temporarily secured within said first leg and may be easily removed when said first pin is not utilized;

a handle assembly including a first elongate handle having a generally square cross section, a first side, a second side, a first end, a second end, and a hole in a top of said first handle, and a second elongate handle having a generally square cross section, a first end, a generally L-shaped second end, and a plurality of holes through a top of said second handle, said first end of said second handle slidingly received within said second end of said first handle so that said hole in said first handle is aligned with one of said plurality of holes in said second handle, wherein a user may grasp said L-shaped second end of said second handle;

a second pin removably received in said hole in said first handle and said one of said plurality of holes in said second handle for securing said second handle to said first handle so that movement within said first handle of said second handle is prohibited during use of said leg stretching apparatus, wherein said second handle is temporarily secured within said first handle and may be easily removed when said second pin is not utilized;

a pair of hinges for securing each of said pair of leg assemblies to said handle assembly, wherein for one of said pair of leg assemblies first leg being secured to said first side of said first handle near said first end of said first handle, and for the other of said pair of leg assemblies first leg being secured to said second side of said first handle near said first end of said first handle, said pair of hinges being adapted for moving said opposite end of said first leg of said one of said pair of leg assemblies generally away from said opposite end of said first leg of said each other of said pair of leg assemblies in a general arc about said pivot end of said first leg of said one and said other of said pair of leg assemblies; and said pivot end of said first leg for each of said pair of leg assemblies is fully engaged with said first handle when each of said pair of leg assemblies is in a fully open position wherein each of said pair of leg assemblies is perpendicular to said handle assembly.

13. The leg stretching apparatus according to claim 12 wherein said first pin includes an exposed end and a distal end, said distal end received within said second leg and having a small protrusion located near said distal end for preventing said first pair of pins from easily sliding out of said hole in said first leg and said one of said plurality of holes in said second leg, said exposed end being larger than either said hole in said first leg or said one of said plurality of holes in said second leg; and said second pin includes an exposed end and a distal end, said distal end received within said second handle and having a small protrusion located near said distal end for preventing said second pin from easily sliding out of said hole in said first handle and said one of said plurality of holes in said second handle, said exposed end being larger than either said hole in said first handle or said one of said plurality of holes in said second handle.

14. The leg stretching apparatus according to claim 12 further comprising a first cushion secured to said opposite end of said second leg and a second cushion secured to said second end of said second handle.

* * * * *